United States Patent [19]

Le Bret

[11] 4,271,778

[45] Jun. 9, 1981

[54] CONTAINER SEAMING CHUCK

[75] Inventor: Lucien Le Bret, Saint-Gratien, France

[73] Assignee: Gallay, S.A., Paris, France

[21] Appl. No.: 54,972

[22] Filed: Jul. 5, 1979

[30] Foreign Application Priority Data

Jul. 7, 1978 [FR] France ..... 78 20321

[51] Int. Cl.[3] ..... B21D 51/32

[52] U.S. Cl. ..... 113/121 AB; 113/121 C

[58] Field of Search ..... 113/23 A, 23 B, 19, 113/58, 116 QA, 120 F, 120 K, 120 R, 121 C, 121 AB; 220/306, 60

[56] References Cited

U.S. PATENT DOCUMENTS

| | | | |
|---|---|---|---|
| 2,181,237 | 11/1930 | Ives | 113/23 A |
| 2,460,296 | 2/1949 | Kinney | 113/19 |
| 2,511,738 | 6/1950 | Rowe et al. | 113/23 A |
| 2,906,430 | 9/1959 | Henchert | 220/60 |
| 3,204,595 | 9/1965 | Brookson | 113/121 C |
| 3,221,922 | 12/1965 | Smith | 220/60 X |
| 3,243,865 | 4/1966 | Brookson | 113/23 AX |
| 3,435,588 | 4/1969 | Johnson et al. | 53/366 |
| 3,540,394 | 11/1970 | Ignell | 113/120 F |
| 3,734,043 | 5/1973 | Rosenbloom | 113/120 BB |

FOREIGN PATENT DOCUMENTS

| | | | |
|---|---|---|---|
| 1220129 | 1/1971 | United Kingdom | 113/23 A |

*Primary Examiner*—Mark Rosenbaum

*Attorney, Agent, or Firm*—Pennie & Edmonds

[57] ABSTRACT

An improved seaming chuck in an apparatus for attaching a cup shaped end member to the body member of a container by a seaming process. The chuck has a recess about its peripheral edge surface for accommodating excess material during the seaming process. The recess also has a varying depth for varying the dimension of the portion of the seam within the recess and preventing relative rotation of the seaming chuck with respect to the container end member during the seaming process.

13 Claims, 3 Drawing Figures

CONTAINER SEAMING CHUCK

TECHNICAL FIELD

The present invention relates to an improved seaming chuck in an apparatus for attaching the cup shaped end member of a container to the body member of the container.

BACKGROUND ART

In the conventional seaming process for seaming the end member of a container to the body member of the container, the edges of the two members are rolled into a seam to form a plurality of layers of material disposed radially outwardly at the end of the container. The seaming apparatus includes one or ore appropriately profiled forming wheels for applying an inwardly directed radial force on the edge portions of the container end and body members as the container is rotated about a fixed axis. The radial force exerted by the forming wheel or wheels during the rolling of the seam is resisted by an internal support. In a conventional seaming apparatus, this internal support is comprised of a seaming chuck having an outer ring attached to a cylindrical central body. The ring is formed with a smooth cylindrical edge surface where it has to withstand the force exerted by the forming wheel or wheels. Beneath this surface, the seaming chuck has a frustoconical portion designed to facilitate the penetration of the seaming chuck into the container end which is generally preformed as a stamped cup shaped member.

The side surface of the container end member bears against the smooth cylindrical wall of the chuck; and as the container end and body members are rotated by the seaming chuck, the force exerted by the opposed forming wheel or wheels, rolls the edges of these members into the seam.

In order to effect a proper seam in conformity with professional standards, it is necessary that the seam provide a uniformly sealed joint about the entire periphery of the container. Present seaming apparatus is not completely satisfactory in this regard, especially where the seam is rolled into a large number of layers of material as with a seam having five or more layers of material. Also, where there are variances in the thickness of the material from which the container end and body members are formed, difficulties in rolling a satisfactory seam have resulted. This is particularly evident where the nominal thickness of the material, typically sheet metal, is substantial and the thickness tolerances produce greater variations in total thickness throughout the sheet metal than would occur if very thin material were used.

In forming an acceptable rolled seam, it is necessary that the layers of material defining this seam be closely compressed against each other around the entire periphery of the container. In order to do this, the seaming apparatus is constructed so that the forming wheel and seaming chuck are radially spaced from each other during the final rolling of the seam by a distance which is generally equal to the nominal thickness of the sheet metal multiplied by the number of layers of material which will be formed at the seam structure. With a triple seam, for example, this spacing will be equal to the thickness of the sheet metal multiplied by seven, five layers of material forming the main body portion of the seam and two layers forming the sides of the container end and body members against which the seam is formed.

If the thickness of the sheet metal were perfectly uniform, a proper seaming would be assured. However, where there are variations in thickness resulting, for example, from the manufacturing tolerances used in the production of the sheet metal, these variations exist and are magnified by the number of layers of material formed at the seam. Of particular significance is the condition where the thickness of the sheet metal is greater than the nominal thickness whereby excess material results at the seam.

With conventional seaming apparatus, thickness variations will tend to produce an improper seam, either one where the sealing effect of the seam is not uniform about the entire periphery of the container or one where excess material has been caused to undergo a cold rolling by being squeezed between the forming wheel and chuck thereby weakening the seam. In some circumstances both conditions may be produced.

In addition to the above problems as caused by thickness variations, conventional seaming chucks have a smooth peripheral edge surface engaging the side surface of the container end member. Such constructions will tend to cause the container end member to slip relative to the edge surface of the chuck. The effects of this slipping on the seaming process are well known to those skilled in the art.

The quality of the rolled seam is closely associated with the regular rotation of the container end member engaged on the seaming chuck, which is directly dependent upon the manner in which the container body and end members are rotated. Moreover, in the case of sheet metal with a protective coating (a preliminary layer of paint, for example), any slip of the container end member on the seaming chuck causes local damage as a result of this protective coating being worn away.

To avoid the slippage problem, seaming chucks have been constructed with knurled or serrated surfaces for engaging against the container end member. Typical constructions are disclosed in U.S. Pat. Nos. 2,181,237, 2,511,738 andd 3,734,043. Although these constructions do provide for a non-slipping type of engagement, they tend to mar or damage the surface of the container end member due to their rough surface. And, as will be appreciated, this can be a serious problem with coated materials.

Seaming chucks have also been constructed with indentations or protuberances on their container engaging surface. Typical constructions are disclosed in U.S. Pat. No. 2,906,430 and 3,221,922 and British Pat. No. 1,220,129. To the extent that these constructions tend to prevent slippage, they do not combine this into a chuck configuration which will also accommodate thickness variations in the container material so as to prevent uneven sealing as well as cold rolling of the material. Generally, this is so because these prior constructions were designed for use in manufacturing thin walled cans where problems of thickness variation are not significant.

DISCLOSURE OF THE INVENTION

In accordance with the teachings of the present invention, an improved seaming chuck is constructed whereby any thickness variation of the sheet metal is accommodated. To this end, the seaming chuck is provided with a recess in its peripheral edge surface. This recess extends around the chuck and is vertically aligned with respect to the opposed forming wheel. With respect to the construction of the container, the recess faces radially outwardly at a level of a first zone disposed at the terminal end of the container. In this first zone, the layers of material extend radially outwardly of the container before turning downwardly away from the end of the container and into a second zone where the main body portion of the seam is disposed. The second zone is spaced from the end of the container and extends along the side surface of the container body member.

In construction the recess is defined by an annular ledge surface facing toward the upper end of the chuck and a recessed side surface facing radially outwardly toward the opposed forming wheel. The side surface extends from the ledge surface to the upper end of the chuck. The recess provides a space for radial inward movement of the layers of material of both the container and body members in the first zone during formation of the rolled seam.

As a further feature of the present invention, the recess is constructed with a non-uniform dimension, either along the ledge or side surface thereof. This provides a varying depth in that direction whereby the portion of the seam formed in the recess also has a varying dimension preventing relative rotation between the peripheral edge surface of the chuck and the end member of the container. This construction provides localized, positive and progressive gripping between the peripheral edge surface of the chuck and the container end member. The improved seaming chuck requires only minor modification of the tools conventionally used for carrying out the seaming process.

Best Mode for Carrying Out the Invention

The following description is directed primarily to the construction of the improved seaming chuck and related parts of the seaming apparatus specific to a seaming process for forming a triple seam.

Figure 1:
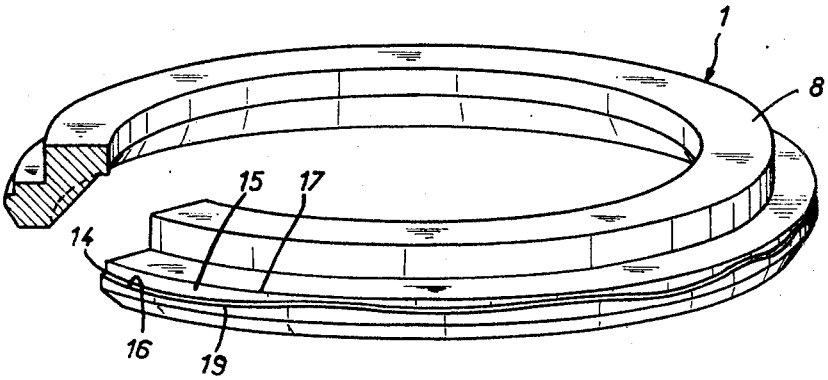
FIG. 1 is a partial cut-away perspective view of a first embodiment of the improved seaming chuck constructed in accordance with the teachings of the present invention.
Figure 2:
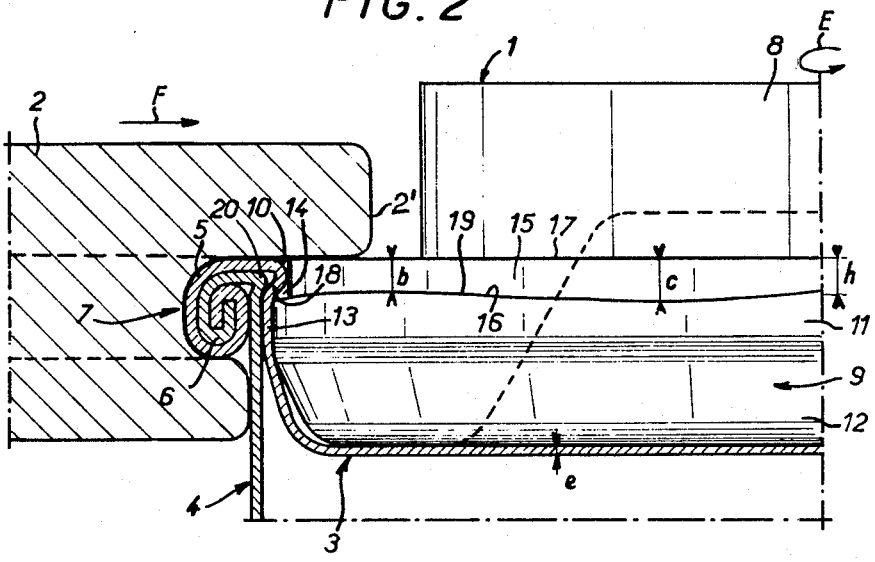
FIG. 2 is a partial cross-sectional view showing the relative positioning of the seaming tools at the end of a seaming operation.

FIGS. 1 and 2 show the seaming chuck 1, the forming wheel 2 and the end 3 and body 4 members of a container, with their respective edge portions 5 and 6 formed into a triple seam generally indicated at 7.

The annular seaming chuck is rotatable in the direction indicated by the arrow E, and comprises a one-piece mounting collar 8 and body 9 with a cylindrical central ring portion 11 and a frustoconical lower portion 12. The central ring portion 11 defines the peripheral edge surface of the chuck which is engageable with the end member along the side portion thereof during the rotation of the chuck to cause rotation of the container.

FIG. 2 shows the relative positions of the chuck 1 and the forming wheel 2 at the extreme end of the travel of the latter, in the direction indicated by the arrow F. The container end member 3 is fitted to the body 9 of the chuck and its edge portion 5 has been rolled with the edge portion 6 of the container body member 4 so as to form a rolled seam which, in this instance, is a triple seam comprising seven thicknesses of material.

The body 9 of the chuck comprises, in the upper region of the cylindrical portion 11, a recess 14 defining a vertical cylindrical, recessed side surface 15 and an undulated horizontal ledge surface 16. The height "h" between the upper end 17 of the chuck and the undulated ledge surface 16 varies in a repetitive and progressive manner between a minimum value "b" and a maximum value "c" thus providing the recess with a varying dimension and depth in the direction of the recessed side surface 15. Depending on the thickness "e" of the edge portion of the container end member, the depth dimension "h" may vary between limit values of about 0 and 5 times "e". The dimension "b" is preferably maintained at approximately 3 times "e" and dimension "c" is preferably 3.5 to 4 times "e". The undulated surface comprises between 10 and 20 regular undulations.

FIG. 2 clearly shows the construction of the seam and the orientation of the parts of the seaming chuck relative to the forming wheel and the layers of material of the seam. As shown, the seam is formed into a plurality of layers of material extending radially outwardly of the container in a first zone at the terminal end of the container. With a triple seam, the layers of material extend substantially horizontally in this zone. They are then bent downwardly in a direction extending away from the end of the container and into a second zone spaced from the terminal end of the container. This second zone contains the main body portion of the seam.

The recess 14 faces outwardly toward the opposed surface of the forming wheel at the location of the first zone and is spaced therefrom by a distance generally equal to the total nominal thickness of the layers of material in this zone. The upper end 17 of the chuck is disposed in closely underlying relation with an enlarged peripheral portion 2′ of the forming wheel to provide an upwardly contained space in which the rolled seam will be formed. The ledge surface 16 of the recess generally separates the first zone from the second zone. Below the recess 14, the peripheral edge surface 11 of the seaming chuck provides the backup surface against which the layers of material are pressed during the seam rolling operation by the opposed surface of the forming wheel.

The recess provides a space for accommodating radially inward movement of the layers of material in the first zone. The material forced into this recess will generally be that which results from excessive thickness of the material or material produced by the local compression of the rolled seam in the second zone. The recess also prevents the cold rolling phenomena in the region of the bends 10 and 20 at the edges of the container end and body members as might normally occur in conventional forming apparatus due to variations in material thickness. The material is permitted to elastically move into this recess.

FIG. 2 also clearly demonstrates the localized and progressive gripping between the container end member 3 and the seaming chuck. Under the effect of the lateral thrust (in the direction of the arrow F) exerted by the forming wheel 2 during the rolling of the edge portions 5 and 6, that portion 18 of the edge portion of the container end member opposite the recess 14 moves into the space defined by this recess, locally engaging the undulated profile of the edge 19 of the horizontal ledge surface 16. Under normal operating conditions, this engagement of the two undulated profiles prevents slip between the container area 13 of the end member 3 and the seaming chuck.

Figure 3:
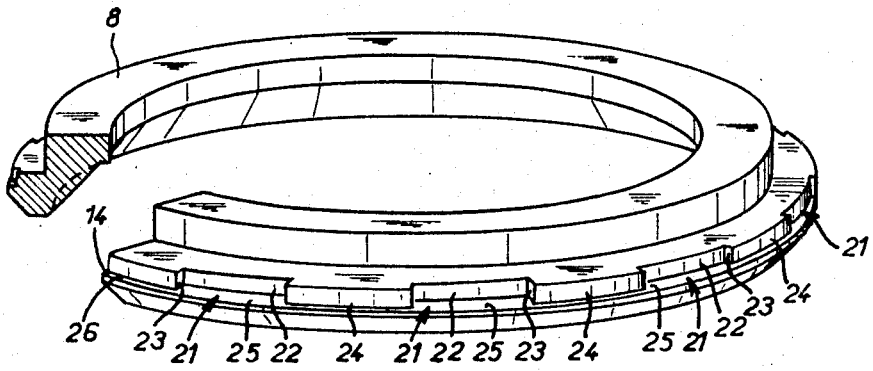
FIG. 3 is a partial cut-away perspective view of a second embodiment of the seaming chuck of the present invention.

FIG. 3 shows another embodiment of the improved seaming chuck constructed in accordance with the invention in which the cylindrical portion 11 of the seaming chuck is constructed with two recessed portions. First, a series of spaced recesses 21 are provided around its peripheral edge surface. These recesses are oriented in a substantially radial direction and communicate with the upper end of the seaming chuck. They are defined by cylindrical rear surfaces 22, radial side surfaces 23 and bottom ledge surfaces 25. Adjacent recesses are separated by cylindrical front surfaces 24. Secondly, as with the embodiment shown in FIGS. 1 and 2, the surface 24 are recessed relative to the peripheral edge surface 11 of the seaming chuck, at the level of the ledge surfaces 25 to provide a recess portion 26 comparable to recess 14. The surfaces 24 thus define the recessed side surface of the recess 26. The recess 26 provides for uniform seaming of the sheet metal, in spite of variations in thickness, and prevents the occurrence of any cold rolling in the region of the bends 10 and 20 at the edges of the container end and body members.

With the embodiment shown in FIG. 3, the radial dimension of the ledge surfaces 25, 26, in effect, varies to provide the recess portions 21 and 26 with a depth that varies in this direction. The bends 10 and 20 at the edges of the container end and body members are thus engaged in the recesses 21 and relative movement is prevented by the resulting anchorage.

In both embodiments of the invention the depth of the recesses may be on the order of one-half the dimension "e", that is, one-half the thickness of the sheet metal. This will facilitate extraction of the seaming chuck.

I claim:

1. In an apparatus for attaching a cup shaped end member to the end of the body member of a container by a seaming process with the end member having a side portion fitted against the internal wall surface of the body member, whereby the edges of the members are rolled into a seam to form a plurality of layers of material extending radially outwardly of the container in a first zone at the terminal end of the container and extending away from the end of the container along the outer side surface thereof in a second zone spaced from the terminal end of the container, said apparatus including a seaming chuck having a lower end disposed within the bottom of the container end member and an upper end separated from the lower end by an outer peripheral edge surface engageable within the end member along the side portion thereof for rotating the container end and body members against a radially outwardly opposed forming wheel to form the rolled seam, the improvement wherein:

(a) the seaming chuck includes a radially inwardly disposed recess extending substantially entirely around the peripheral edge surface of the chuck, said recess being vertically aligned with respect to the opposed forming wheel and facing radially outwardly at the level of said first zone to provide a space for radially inward movement of the layers of material of the container end and body members in said first zone during formation of the rolled seam.

2. The improvement in the apparatus according to claim 1 wherein:

(a) the recess in the seaming chuck is defined by an annular ledge surface facing toward the upper end of the chuck and a recessed side surface facing radially outwardly toward the opposed forming wheel and extending from said ledge surface to the upper end of the chuck.

3. The improvement in the apparatus according to claim 2 wherein:

(a) the ledge surface of the recess of the seaming chuck is oriented relative to the forming roll to generally define a line of demarcation between the first and second zones of layered material.

4. The improvement in the apparatus according to claim 3 wherein:

(a) the upper end of the chuck is disposed in closely underlying relation with a peripheral portion of the forming wheel.

5. The improvement in the apparatus according to claim 2 wherein:

(a) the recess in the seaming chuck has a non-uniform dimension along either the ledge or side surface thereof to provide a varying depth in that direction whereby the portion of the seam formed in said recess has a varying dimension preventing relative rotation between the peripheral edge surface of the chuck and the end member of the container.

6. The improvement in the apparatus according to claim 5 wherein:

(a) the side surface of the recess in the seaming chuck, as measured from the upper end of the chuck to the ledge surface, has a varying depth up to 5 times the thickness of the container end member to provide an undulating ledge surface.

7. The improvement in the apparatus according to claim 5 wherein:

(a) the side surface of the recess in the seaming chuck, as measured from the upper end of the chuck to the ledge surface, has a varying depth of between about 3 and 4 times the thickness of the container end member to provide an undulating ledge surface.

8. The improvement in the apparatus according to either one of claims 6 and 7 wherein:

(a) the ledge surface of the recess in the seaming chuck comprises between 10 and 20 undulations.

9. The improvement in the apparatus according to claim 5 wherein:

(a) the ledge surface of the recess in the seaming chuck, as measured in a radial dimension, has a varying depth.

10. The improvement in the apparatus according to claim 9 wherein:

(a) the recess in the seaming chuck comprises a first portion extending completely around the peripheral edge surface of the chuck and a plurality of second portions spaced around the peripheral edge surface and extending radially inwardly of the first portion.

11. The improvement in the apparatus according to claim 10 wherein:

(a) the second portions of the recess in the seaming chuck are defined by:

(1) a rear surface extending from the ledge surface to the upper end of the chuck, (2) radial side surfaces extending from the ledge surface to the upper end of the chuck, and (3) annular sector-shaped bottom surfaces defined by the ledge surface of the recess; and (b) the adjacent second portions of the recess are separated from each other about the periphery of the chuck by the side surfaces of the first portion of the recess.

12. An improved method of forming a rolled container seam between the edges of a container body member and cup shaped container end member wherein the cup shaped end member is fitted into the end of the body member of a container by a seaming process with the end member having a side portion fitted against the internal wall surface of the body member, with the edges of the members being rolled into a seam to form a plurality of layers of material extending radially outwardly of the container in a first zone at the terminal end of the container and extending away from the end of the container along the outer side surface thereof in a second zone spaced from the terminal end of the container, the improved method comprising the steps of:

(a) providing a radially inwardly directed space extending completely around the terminal end of the container adjacent the layers of material in said first zone and extending radially inwardly of the side portion of the end member; and (b) rolling the edges of the end and body members together to form said seam by:

(1) internally supporting the side portion of the end member with a seaming chuck, and (2) moving a forming wheel radially inwardly against the edges of the end and body members in the area of the first and second zones while effecting rotation of the body and end members about the longitudinal axis of the container;

(c) said radially inwardly directed space accommodating radial inward movement of the layers of material of the container end and body members from said first zone during formation of the rolled seam.

13. The method according to claim 12 wherein:

(a) the radially inwardly directed space is of varying dimension radially or vertically of the longitudinal axis of the container.

* * * * *